United States Patent [19]

James et al.

[11] Patent Number: 4,736,808

[45] Date of Patent: Apr. 12, 1988

[54] PERCUSSIVE TOOL WITH HIGH PRESSURE FLUID JET

[75] Inventors: Bruce James; John P. Dorscht, both of Collingwood, Canada

[73] Assignee: Canadian Patents and Development Limited/Societe Canadienne des Brevets et d'Exploitation Limitee, Ottawa, Canada

[21] Appl. No.: 918,042

[22] Filed: Oct. 14, 1986

[51] Int. Cl.[4] ..... E21B 1/02; E21B 10/38

[52] U.S. Cl. ..... 175/135; 173/80; 175/211; 175/417; 175/424

[58] Field of Search ..... 175/417, 422 R, 67, 175/393, 208, 209, 211, 414, 135; 299/17; 173/80, 57; 405/248, 236; 239/271, 600

[56] References Cited

U.S. PATENT DOCUMENTS

| | | | |
|---|---|---|---|
| 885,337 | 4/1908 | Gilbreth | 405/248 |
| 998,910 | 7/1911 | Lange | 173/57 |
| 1,833,477 | 11/1931 | Tomanek | 175/417 |
| 3,055,442 | 9/1962 | Prince | 175/422 R |
| 4,280,572 | 7/1981 | Schmid et al. | 175/417 |
| 4,290,496 | 9/1981 | Briggs | 175/321 |
| 4,313,570 | 2/1982 | Olson | 239/583 |
| 4,369,850 | 1/1983 | Barker | 175/422 R |
| 4,610,321 | 9/1986 | Whaling | 175/422 R |

FOREIGN PATENT DOCUMENTS

| | | | |
|---|---|---|---|
| 585150 | 2/1925 | France | 405/248 |
| 2372309 | 7/1978 | France | 175/422 R |
| 738134 | 10/1955 | United Kingdom | 175/393 |
| 1462371 | 1/1977 | United Kingdom . | |

*Primary Examiner*—James A. Leppink
*Assistant Examiner*—Hoang C. Dang
*Attorney, Agent, or Firm*—Ridout & Maybee

[57] ABSTRACT

In a percussive tool in which a very high pressure and preferably cavitating water jet is directed through an opening in the working surface of the tool, the jet is formed by a nozzle positioned in a cavity behind the opening and decoupled from the tool by a bearing layer of water from the jet. A supply pipe extends rearwardly of the nozzle without contacting the tool, and is supported externally of the tool, on a machine which operates the tool, by a support which allows the fluid bearing to center the nozzle within the cavity while restraining movement of the nozzle axially of the tool.

8 Claims, 2 Drawing Sheets

PERCUSSIVE TOOL WITH HIGH PRESSURE FLUID JET

The invention relates to tools in which the application of high pressure liquid jets is combined with mechanical shock in achieving a desired operation upon a work zone.

Various tools are known which utilize high pressure liquid jets, with or without cavitation, to carry out or assist in the cutting, drilling and surface treatment of various substances, usually minerals. Other tools are known which utilize mechanical shock to break, split or drill minerals, such as hammers and impact drills. It is also known to utilize high pressure fluid in conjunction with the latter type of tool, as disclosed for example in British Patent Specification No. 1,462,371 (Dobson Park Industries).

In U.S. Pat. No. 4,610,321 issued Sept. 9, 1986 to Michael H. Whaling, there is disclosed a tool in which a high pressure cavitating jet is directed onto a working surface through a cavity in the working face of an impact tool, and in U.S. Pat. No. 4,280,572, there is disclosed a percussive chisel, equipped with a high pressure water jet at the cutting tip, although there is no disclosure in this latter patent of what pressure is contemplated, and it does not appear that cavitation is a factor.

Although it has been ascertained that the Whaling tools are highly effective in use, problems have been encountered in maintaining the water connections to the nozzle in the tool. The combination of the percussive forces applied to the tool with the very high pressures being handled, together with the necessity to accommodate relative movement between the tool and the support, leads to fairly rapid failure of the connection between the flexible pipe and the tool even if the latter is very carefully designed and maintained. The percussive forces not only stress the connection to the water supply directly, but set up shock waves in the water upstream of the nozzle which may have a deleterious effect on the integrity of the supply conduit. Sliding gland connections can be used in such applications, but add considerably to the complexity of the tool if located internally and are difficult to accommodate externally. Moreover, the axially sliding seals necessarily incorporated in such arrangements are a weak point and the arrangement is still exposed to shock waves transmitted through the water itself, and to side loadings from sideways movement of the tool.

The object of the present invention is to provide a percussive tool incorporating a high pressure liquid jet nozzle discharging through an impact face of the tool, in which deterioration of the liquid supply line due to percussive forces applied to the tool can be greatly reduced, as well as transmission of mechanical side loads to the line by sideways tool movement and of shock forces to the liquid upstream of the nozzle.

According to the invention, in a percussive tool comprising a liquid jet nozzle discharging through an opening in a front impact face of the tool, the tool is formed to define an elongated cavity extending rearwardly through the tool to a rear opening remote from the front opening, a supply pipe is provided extending from a connection to a source of very high pressure liquid through the elongated cavity from its rear opening to the liquid jet nozzle, the pipe being spaced from the tool throughout its length, and a bearing is provided rearward of the nozzle to control the radial position of the jet nozzle and the pipe within the cavity, said bearing incorporating a bearing layer of liquid between the pipe and the peripheral wall of the cavity.

By floating bearing is meant a bearing arrangement which supports the nozzle within the cavity without obstructing its longitudinal movement, whilst permitting it a certain amount of radial float. Without such float, any lateral shocks applied to the tool will be transmitted directly to the pipe and nozzle through the bearing, with deleterious consequences both for the pipe and the bearing. Such a floating bearing may be provided by a fluid bearing in which the layer is formed by spent liquid from the jet and is of significant thickness, which implies a clearance between the bearing surfaces, or by a resilient bearing member in conjunction with a thin film of spent liquid between the bearing surfaces, or any other bearing arrangement which will allow both relative axial and relative radial movement between the pipe and the wall of the cavity, with the pipe decoupled from the vibration of the tool by a liquid bearing layer. It has been found that the use of elastomeric mountings for the pipe, without the presence of the decoupling liquid layer, tends to provide inadequate decoupling and to lead to premature failure of the supply pipe, the mountings, or both.

With the arrangement of the invention, the jet nozzle is located radially within the cavity so as to direct its jet nozzle through the front opening, but the percussion applied is largely decoupled from the jet nozzle and its supporting pipe. It is therefore possible to couple a high pressure liquid supply to the pipe without the coupling being subjected to large percussive forces. Typically the direction of the cavity in the tool and of the pipe therein diverges from the percussive axis of the tool so as to facilitate external support of the pipe.

Further features of the invention will become apparent from the following description of exemplary embodiments of the invention with reference to the accompanying drawings.

IN THE DRAWINGS

DESCRIPTION OF THE PREFERRED EMBODIMENTS

Figure 1:
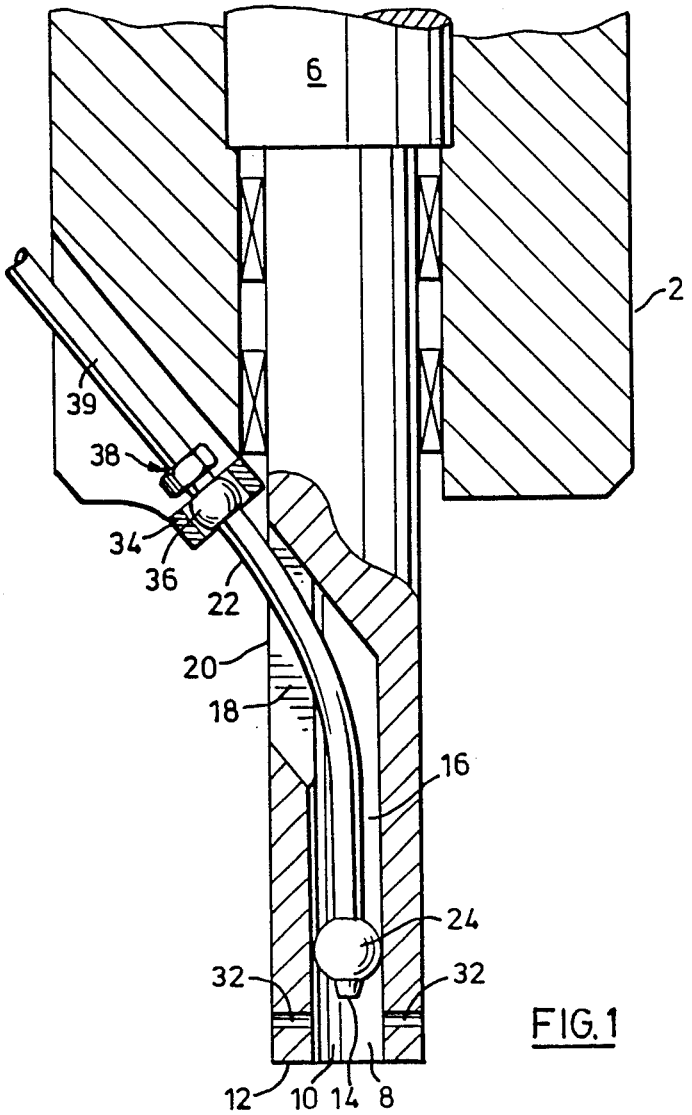
FIG. 1 is a longitudinal cross section through parts of the percussion hammer of a rock breaking machine incorporating the invention.

Referring to FIG. 1, there is shown part of the percussive hammer 2 of a rock breaking machine. The hammer tool 4 is held against rock to be broken by means of the boom and percussive forces are applied to it by an impactor piston 6. As thus far described, the machine is conventional. The percussion hammer tool 4 is constructed in accordance with the principles set forth in the aforementioned Whaling U.S. Pat. No. 4,610,321, the text of which is hereby incorporated herein by reference, except for the mounting of the jet nozzle 14 and the arrangement of the water supply thereto. Thus the cylindrical cavity 8 extending rearwardly from an opening 10 in the front face 12 of the tool 4 is extended rearwardly at 16 past the nozzle 14 and then inclined and broadened laterally at 18 to a rear opening in the form of an axially extending slot 20 in the side wall of the hammer tool 4. Rearwardly of and integral with the nozzle 14 is a fluid bearing unit 24 threaded onto the end of a supply pipe 22, which is bent so as to pass back through the cavity portions 16 and 18 and cut through the slot 20 without contacting the walls of the cavity. The bearing unit 24 has spheroidal side walls and is a clearance fit within the cavity. Spent low pressure water accumulating in the chamber 8 after impact of the jet 14 on the working surface discharges through lateral bores 32, bedding of the front face 12 against the working surface and acting to limit the escape of water at the front of the tool.

Figure 3:
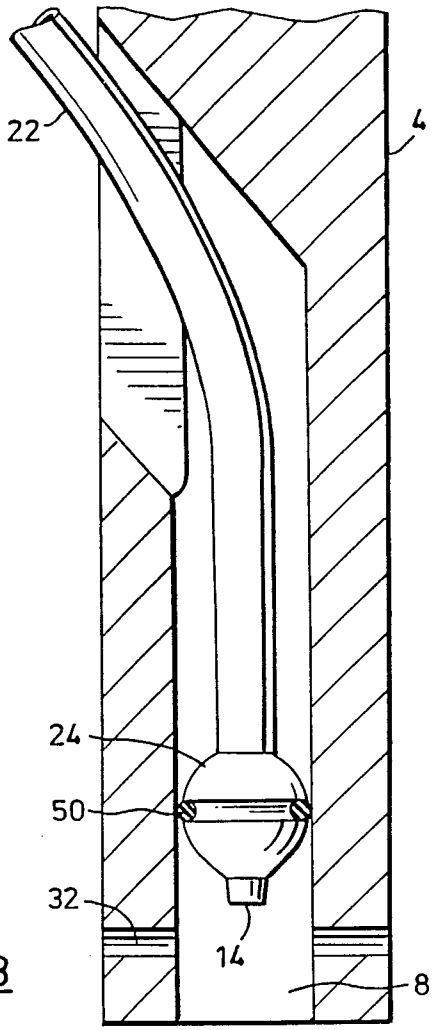
FIG. 3 illustrates on an enlarged scale a modification of parts of the percussion hammer shown in FIG. 1.

In place of or additional to the bores 32, provision is made for water to escape rearwardly past the bearing unit 24, either by further increasing the clearance between the unit and the bore, or by forming channels in the bearing unit or the bore between the bearing pads. This escaping low pressure water passes through the annular venturi formed by the clearance between the bearing unit 24 and the wall, thus completing a fluid bearing which is capable of a certain amount of radial float, and can help to absorb lateral shocks and deflections applied to the tool before they are transmitted to the pipe 22. Rather than relying on escaping water to provide float in the bearing, the bearing unit 24 may be modified as shown in FIG. 3 by the application of a soft elastomeric O-ring 50 in an equatorial groove 52 formed in the unit. The desired float is then provided by the resilience of the O-ring, which slides on a film of water formed on the wall of the cavity 14 but does not permit substantial leakage past the bearing unit 14. The O-ring could be replaced by a flexible lip seal, similarly sliding on a thin film of water.

The pipe 22 is extended rearwardly and outwardly of the tool 4 to a support 34 on the hammer 2, this support incorporating a spherical thrust bearing 36 so that the pipe can swivel to allow the fluid bearing unit 24 to centre itself in the bore 8 and to avoid forcible contact of the pipe with the tool when the tool is misaligned in the hammer underside loading. The support restrains the pipe 22 against axial motion, and sustains the thrust of the jet from the nozzle 14. Upstream of the support is a connection 38 to a high pressure water supply pipe 39. This connection is not subject to percussive forces, and may be implemented by using conventional high pressure hydraulic practice.

Figure 2:
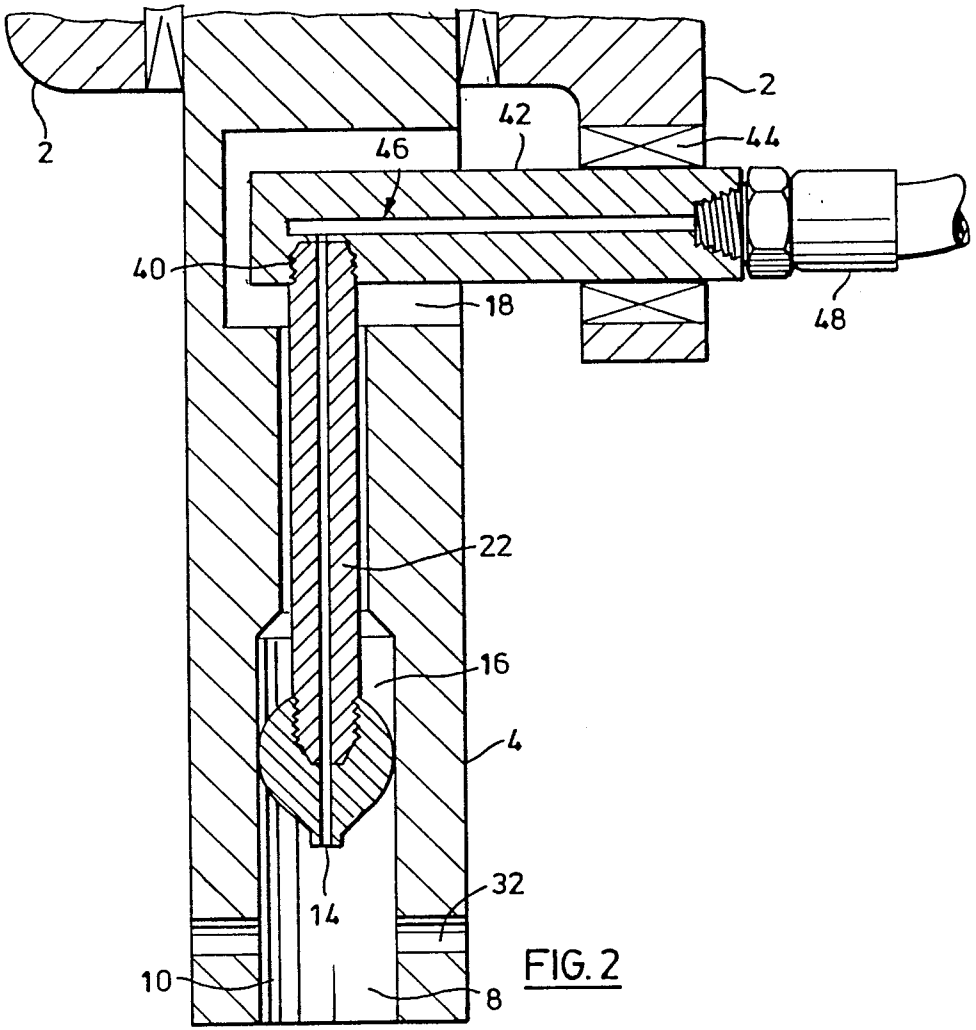
FIG. 2 illustrates in section parts of an alternative embodiment of percussion hammer incorporating the invention.

An alternative supporting arrangement for the pipe 22 is shown in FIG. 2, in which like parts are designated by the same reference numerals as in FIGS. 1 and 3. The portion 18 of the cavity extends perpendicularly to the portion 16, and instead of the pipe 22 being bent so as to pass through the opening 20, it is straight and terminates at a threaded connection 40 to a perpendicularly extending transfer shaft 42 which is supported in a support bearing 44 mounted on the hammer 2 which permits radial and longitudinal movement of the shaft and thus permits the fluid bearing unit to centre the nozzle 14 in the cavity 8. The shaft 42 is drilled with a bore 46, terminating in a threaded socket at the outer end of the shaft coupled to a high pressure water hose 48.

Although the invention has been described with reference to a rock breaking machine equipped with a hammer, it may be utilized with other machines utilizing other types of impact tools through the working of which it is desired to direct a very high pressure (typically at least 2,000 p.s.i.) stream of liquid, usually but not necess. rily water. Thus the invention could be applied to the bit of an impact drill in which case it may be preferred to extend the cavity through an opening 20 in the rear rather than the side of the tool so as to avoid lateral protrusions from the tool.

In use, the fluid bearing supporting the nozzle within the bore reduces friction between the nozzle and the tool to a very low level, greatly reducing the transfer of shock forces to the nozzle 14, to the pipe 22, and to the liquid within the pipe. Experiments show that with the arrangement of the invention, it is possible to establish high pressure water connections to the tool which remain reliable over extended periods, whereas the use of conventional hydraulic connections to a nozzle fixed within the tool resulted either in early failure or required frequent maintenance to preserve their integrity.

We claim:

1. In a percussive machine tool having a tool comprising a liquid jet nozzle discharging directly outwardly through a front opening in a front impact face of the tool, the improvement wherein the tool is formed to define an elongated cavity extending rearwardly from the front opening through the tool to a rear opening remote from the front opening, a substantially rigid supply pipe extending from a connection to a source of very high pressure liquid through the elongated cavity from its rear opening to the liquid jet nozzle, the pipe being spaced from the tool throughout its length, a radial bearing provided rearward of the nozzle to control the radial position of the jet nozzle and the pipe within the cavity, said bearing being of a size to provide a bearing layer of liquid from said nozzle to pass between the bearing and the peripheral wall of the cavity, and the machine includes means to mount the pipe to a portion of the machine, which portion is not itself subject to percussive forces, whereby the jet nozzle and the supply pipe are isolated from such percussive forces and axial forces generated by the jet nozzle are sustained by the mounting means.

2. A percussive machine according to claim 1, wherein the direction of the cavity of the tool and of the pipe therein diverges from the percussive axis of the tool so that the pipe emerges through an opening in the side of the tool.

3. A percussive machine according to claim 1, wherein the mounting means include a further bearing permitting radial movement of the pipe within the cavity but restraining it against axial movement.

4. A percussive machine according to claim 3, wherein the mounting means is a spheroidal bearing.

5. A percussive machine according to claim 3, wherein the mounting means is a shaft extending laterally of the pipe through an opening in the side of the tool, and a further bearing mounting the shaft for rotational and axial movement.

6. A percussive machine according to claim 1, wherein the radial bearing comprises a bearing member mounted on the pipe and presenting a spheroidal surface, and the bearing member is a clearance fit within the cavity defined in the tool, the peripheral wall of which cavity is cylindrical adjacent the bearing member, whereby to define a peripheral passage for spent liquid from the jet nozzle to pass between the bearing member and the peripheral wall and form said liquid layer.

7. A percussive machine according to claim 6, wherein the width of the passage between the bearing member and the wall of the cavity is sufficient to provide a primary exhaust passage for spent water from the jet nozzle.

8. A percussive machine according to claim 1, wherein the radial bearing comprises a bearing member mounted on the pipe and presenting a readily deformable outer bearing surface, and a fluid bearing film is formed between this surface and the peripheral wall of the cavity.

* * * * *